US006575773B1

(12) United States Patent
Takeuchi

(10) Patent No.: US 6,575,773 B1
(45) Date of Patent: Jun. 10, 2003

(54) CONNECTOR FOR SURFACE MOUNTING AND METHOD OF MANUFACTURING THE SAME

(75) Inventor: Shinobu Takeuchi, Koriyama (JP)

(73) Assignee: Moldec Co., Ltd., Fukushima (JP)

( * ) Notice: Subject to any disclaimer, the term of this patent is extended or adjusted under 35 U.S.C. 154(b) by 0 days.

(21) Appl. No.: 10/048,073

(22) PCT Filed: Jul. 19, 2000

(86) PCT No.: PCT/JP00/04845

§ 371 (c)(1),
(2), (4) Date: Jan. 29, 2002

(87) PCT Pub. No.: WO01/09985

PCT Pub. Date: Feb. 8, 2001

(30) Foreign Application Priority Data

Jul. 29, 1999 (JP) ..... 11-249159
Nov. 2, 1999 (JP) ..... 11-311817

(51) Int. Cl.[7] ..... H01R 12/20
(52) U.S. Cl. ..... 439/79
(58) Field of Search ..... 439/79, 83

(56) References Cited

U.S. PATENT DOCUMENTS 5,772,453 A * 6/1998 Tan et al. ..... 439/79
5,975,918 A * 11/1999 Quillet et al. ..... 439/79
6,129,562 A * 10/2000 Hong ..... 439/79
6,174,172 B1 * 1/2001 Kazama ..... 439/83

* cited by examiner

*Primary Examiner*—Gary Paumen
(74) *Attorney, Agent, or Firm*—Paul A. Guss

(57) ABSTRACT

The invention provides a connector for surface mounting capable of forming a contact without offsetting so as to assemble in a case in order to solve the disadvantage mentioned above. As shown in FIG. 4(*a*), a contact (3) formed substantially in a straight line shape is pressure inserted to a through hole (10) provided in a holding part (9) of a case (2). Next, as shown in FIG. 4(*b*), a connection part (6) of the upper contact (3) is held by upper and lower jigs (12), and a terminal part is gripped by a bending jig (13) provided with a gripping portion having substantially the same diameter as that of the terminal part (7). Next, as shown in FIG. 4(*c*), the connection part (6) of the upper contact (3) is bent obliquely downward by obliquely downward drawing down the bending jig (13). With respect to the connection part (6) of the lower contact (3), as shown in FIG. 4(*d*), the connection part (6) of the lower contact (3) is bent obliquely upward by obliquely upward drawing up the bending jig (13). Accordingly, it is possible to form a connector (1) in which the terminal parts (7) of the upper contact (3) and the lower contact (3) are arranged in one line in a width direction of the connector (1).

2 Claims, 5 Drawing Sheets

CONNECTOR FOR SURFACE MOUNTING AND METHOD OF MANUFACTURING THE SAME

TECHNICAL FIELD

The present invention relates to a connector surface-mounted on a circuit board of a personal computer or the like, and a method of manufacturing the same.

BACKGROUND ART

A connector surface-mounted on a circuit board S of a personal computer or the like is structured, as shown in FIG. 6(*a*), such that plural pairs of upper and lower contacts 23 are arranged in a width direction in a case 22, and are arranged so that terminal parts 27*a* of upper contacts 23*a* and terminal parts 27*b* of lower contacts 23*b* alternately form one line on a rear surface of the case 22. The conventional contact 23 employed in the connector 21 mentioned above is provided with terminal parts 27 surface-mounted on contact portions 24 being in contact with a contacted portion (not shown) of a connector in a side to be connected and the circuit board S, connection parts 26 for connecting the contact portions 24 and the terminal parts 27, and insert portions 25 inserted to the case 22, as shown in FIG. 6(*b*). Further, the contact 23 is structured such that the terminal parts 27 and the connection parts 26 are offset in a width direction with respect to the contact portions 24 so that the terminal parts 27 are arranged in one line, and the connection parts 26 are bent downward or upward, as shown in FIGS. 6(*a*) and 6(*c*).

However, since the width of the contact 23 is increased in the width direction at an amount of offset when the contact 23 is offset, there is a disadvantage that a lot of disuse portions are generated in a metal plate in the case of punching the contact 23 from the metal plate on the basis of a press metal mold. Further, in the case of assembling the contact 23 in the case 22 by an automatic assembling apparatus, it is necessary to align the scattered contacts 23 in a predetermined direction so as to assemble in the case 22, so that since it is necessary to align the direction of the offset, there is a disadvantage that the apparatus becomes complex.

An object of the present invention is to improve a connector, and more particularly to provide a connector for surface mounting capable of forming a contact without offsetting so as to assemble in a case in order to solve the disadvantage mentioned above.

DISCLOSURE OF THE INVENTION

In order to achieve the object mentioned above, in accordance with the present invention, there is provided a connector for surface mounting comprises a case formed by an insulating body, contacts formed by a conductive body and in which a contact portion being in contact with a contacted portion of a connector to be connected is provided in a forward portion and a terminal part being surface-mounted on a circuit board is provided in a rearward portion, the contacts being arranged so as to extend through the case and form a pair of upper and lower contacts and a plurality of parallel lines in a width direction, and terminal parts of the upper contacts and terminal parts of the lower contacts being alternately arranged so as to form one line, characterized in that a connection part for connecting the contact portions and the terminal parts is formed in a cylindrical shape and obliquely bent in a predetermined direction, and the terminal parts of the upper contacts and the terminal parts of the lower contacts are alternately arranged so as to form one line.

Further, in order to achieve the object mentioned above, in accordance with the present invention, there is provided a method of manufacturing a connector for surface mounting, the connector comprising a case formed by an insulating body, contacts formed by a conductive body and having a contact portion being in contact with a contacted portion of a connector to be connected in a forward portion, a terminal part being surface-mounted on a circuit board in a rearward portion, and an inserted portion inserted to the case, the contacts being arranged so as to extend through the case, be held by the inserted portion and form a pair of upper and lower contacts and a plurality of parallel lines in a width direction, and terminal parts of the upper contacts and terminal parts of the lower contacts being alternately arranged so as to form one line, characterized by the steps of punching a metal plate so as to form a rectangular columnar contact, press molding the rectangular columnar contact so as to form a connection part for connecting the inserted portion and the terminal part in a cylindrical shape, attaching the contacts formed in the straight line shape to the case so as to form a pair of upper and lower contacts, and obliquely bending the connection part in a width direction and a vertical direction in a state of holding the terminal part horizontally so as to alternately arrange the terminal parts of the upper contacts and the terminal parts of the lower contacts in one line.

Since the connection part is formed in the cylindrical shape, it is possible to obliquely bend as is different from the conventional rectangular connection part. Accordingly, in the connector for surface mounting and the manufacturing method thereof in accordance with the present invention, it is possible to alternately arrange the terminal parts of the upper contacts and the terminal parts of the lower contacts in one line by forming the contacts without offsetting, assembling in the case and thereafter bending the connection part. Accordingly, since it is not necessary to previously offset as in the conventional structure at a time of forming the contacts, it is possible to reduce a disuse portion in the metal plate corresponding to the material for the contacts. Further since it is not necessary to take the offset of the contacts into consideration at a time of previously assembling the contacts in the case by the automatic assembling apparatus, it is possible to make the apparatus simple.

BEST MODE FOR CARRYING OUT THE INVENTION

Figure 1:
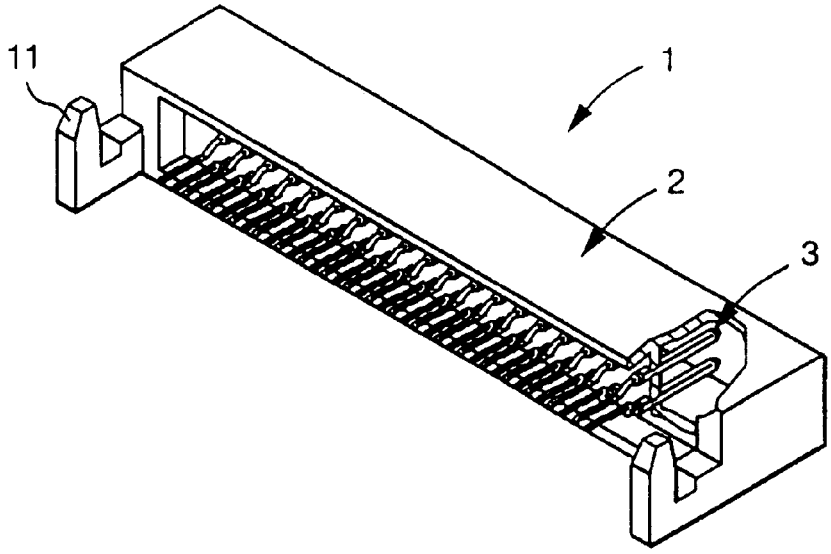
FIG. 1 is a perspective view of a partly notched state showing one example of an embodiment of a connector in accordance with the present invention.

Next, a description will be given of one example of an embodiment of a connector for surface mounting in accordance with the present invention with reference to FIGS. 1 to 5. A connector 1 in accordance with the present embodiment is, as shown in FIG. 1, provided with a case 2 and contacts 3, and corresponds to a connector for surface mounting which is surface-mounted on a terminal part provided on a circuit board.

Figure 2:
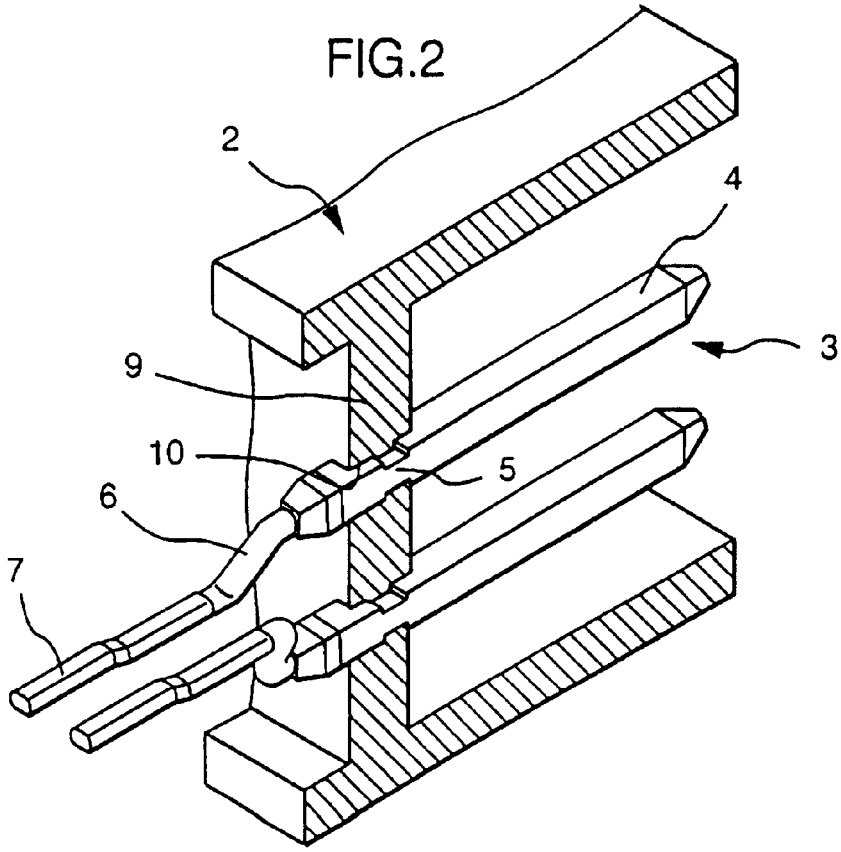
FIG. 2 is a perspective cross sectional view showing a state in which a contact is attached to a case.
Figure 3:
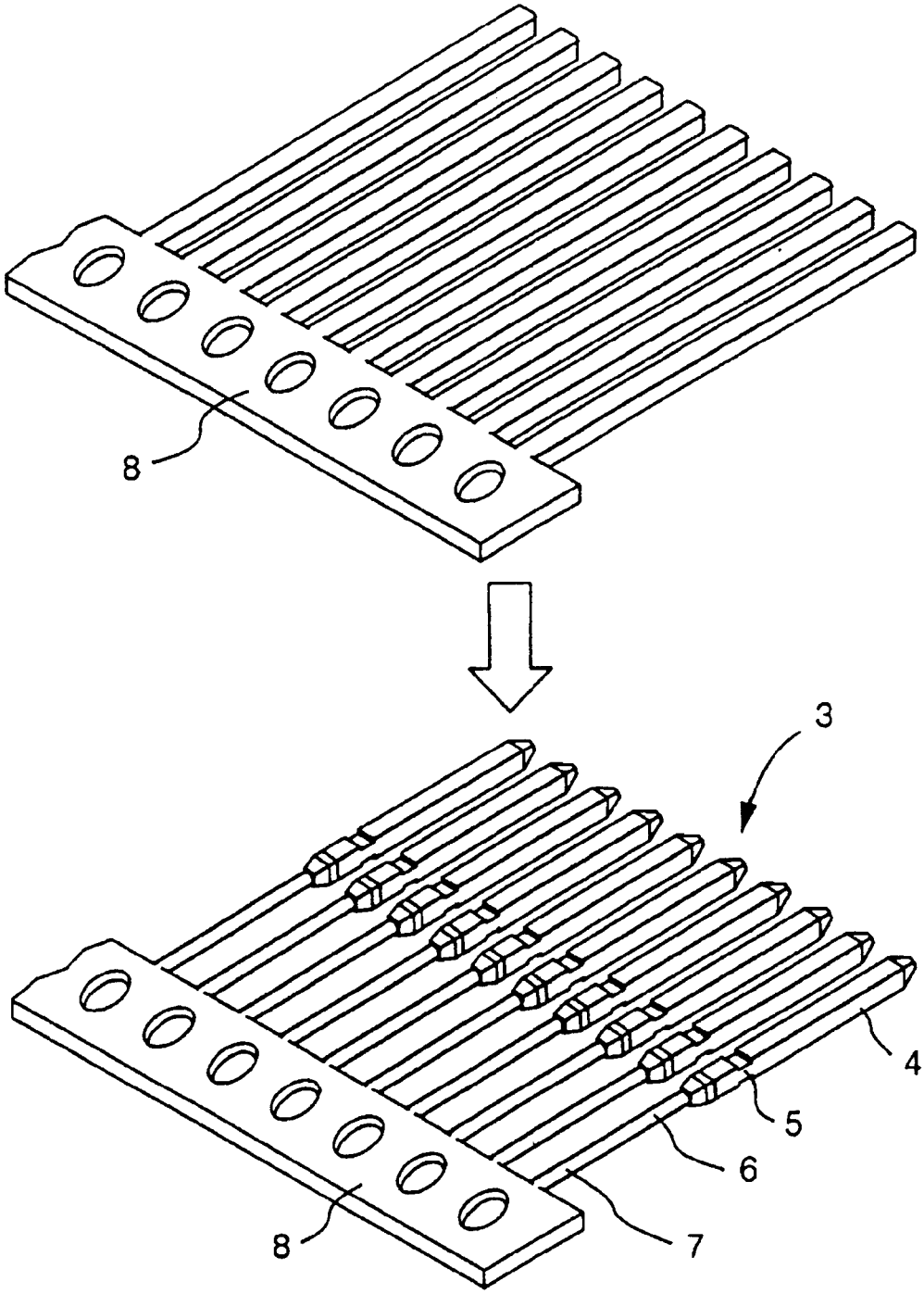
FIG. 3 is a schematic view showing a forming step of the contacts.
Figure 4A:
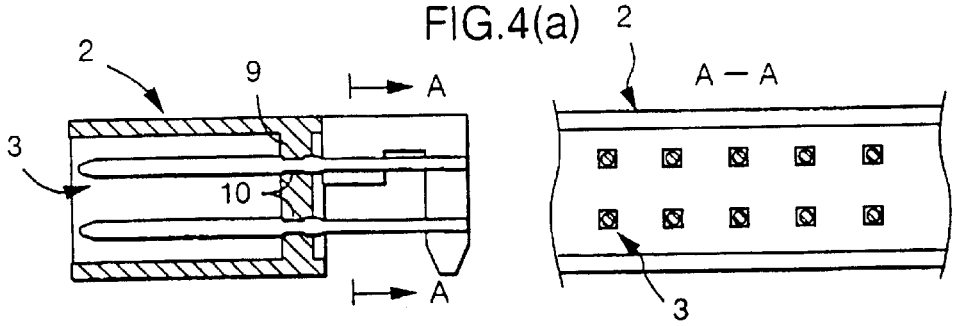
FIGS. 4(*a*) to 4(*d*) are schematic views showing a bending process step of the contacts.
Figure 4B:
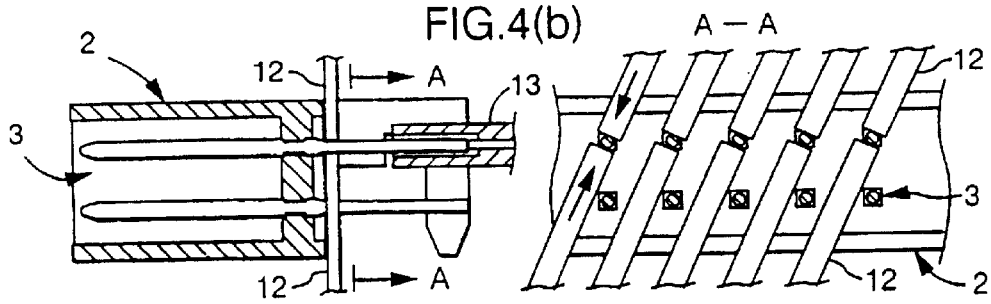
Figure 4C:
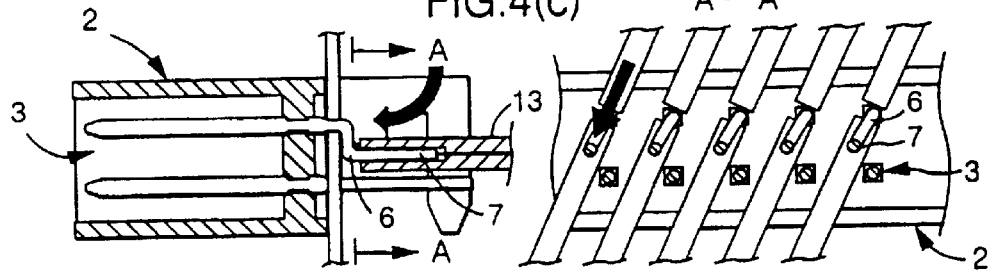
Figure 4D:
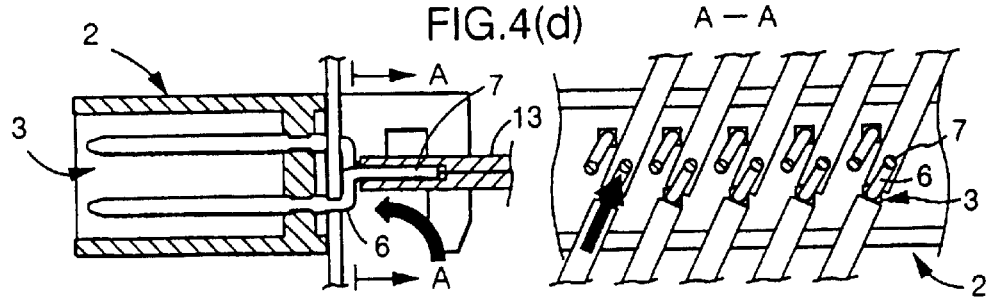

The contact 3 is, as shown in FIG. 2, provided with a contact portion 4 extended to a forward portion of the case 2 and being in contact with a contacted element (not shown) of a connector in a connected side, an inserted portion 5 inserted to the case 2, a connection part 6 protruding out to a rearward portion of the case 2, and a terminal part 7 extended rearward from a rear end of the connection part 6.

The contacts 3 in accordance with the present invention are formed by punching one sheet of copper alloy metal plate and working by a press metal mold (not shown). The contacts 3 are connected by a carrier 8 as shown in an upper drawing in FIG. 3 in a state of being punched out from the metal plate, and a whole thereof is formed in a rectangular column shape. Further, by press molding from this state, as shown in a lower drawing in FIG. 3, the connection parts 6 and the terminal parts 7 are formed in a cylindrical shape. In this case, the press molding is executed by three separated steps comprising a rough press, an intermediate press and a finish press. Further, in the case of assembling the contacts 3 in the case 2 by an automatic assembling machine (not shown), the formed contacts 3 are supplied to the automatic assembling machine in a state of being cut from the carrier 8.

The case 2 is made of an insulating synthetic resin, and is formed in a rectangular column shape having an open front surface. A holding part 9 for holding the inserted portions 5 of the contacts 3 is provided in the case 2, as shown in FIG. 2, and through holes 10 formed so as to have a slightly smaller size than that of the inserted portions 5 of the contacts 3 are formed in portions of the holding part 9 in which the contacts 3 are held. Further, a fixing leg 11 fixed to the circuit board is provided in the case 2, as shown in FIG. 1.

Next, a description will be given of a manufacturing step of the connector 1. At first, as shown in FIG. 4(*a*), the contact 3 formed substantially in a straight line shape is pressure inserted to the through hole 10 provided in the holding part 9 of the case 2 by the automatic assembling apparatus (not shown). Accordingly, the inserted portion 5 of the contact 3 is held by the holding part 9 of the case 2. At this time, since the contact 3 is formed in the straight line shape, it is not necessary to position with taking the direction of the offset into consideration as in the conventional structure.

Next, the bending process of the connection part 6 is executed. At first, as shown in FIG. 4(*b*), a holding jig 12 is moved toward the upper contact 3 from an obliquely upper portion and an obliquely lower portion, and the connection part 6 of the upper contact 3 is held by the upper and lower jigs 12. Further, at the same time, the terminal part is gripped by a bending jig 13 provided with a gripping portion having substantially the same diameter as that of the terminal part 7 of the upper contact 3. Further, as shown in FIG. 4(*c*), the connection part 6 of the upper contact 3 is bent obliquely downward by obliquely downward drawing down the bending jig 13 in a state of holding the connection part 6 of the upper contact 3 by the holding jig 12. Further, the upper and lower holding jigs 12 are respectively moved apart from the upper contact 3, and the bending jig 13 is moved apart from the terminal part 7. Accordingly, the bending process of the connection part 6 in the upper contact 3 is executed.

Next, the connection part 6 of the lower contact 3 is held by the holding jig 12 and the terminal part 7 is gripped by the bending jig 13. Further, as shown in FIG. 4(*b*), the connection part 6 of the lower contact 3 is bent obliquely upward by obliquely upward drawing up the bending jig 13. Accordingly, the terminal parts of the upper contact 3 and the lower contact 3 are arranged so as to form one line in a width direction of the connector 1.

Next, the terminal part 7 is formed in a shape shown in FIG. 2 by press molding the terminal parts 7 arranged in one line in accordance with the bending process mentioned above by a press machine (not shown). The connector 1 in accordance with the present embodiment is formed on the basis of the steps mentioned above. In the case of mounting the formed connector 1 to the circuit board, the case 2 is fixed to the circuit board by the fixed leg 11 provided in the case 2, and the terminal part 7 is soldered to the terminal part of the circuit board.

In accordance with the connector 1 for surface mounting in accordance with the present embodiment, since the connection part 6 is formed in the cylindrical shape as mentioned above, it is possible to easily arrange the terminal parts 7 in one line in the width direction by assembling the contact 3 in the case 2 and thereafter applying the bending process to the connection part 6. Accordingly, since it is not necessary to previously apply the offset to the contact 3 as in the conventional structure, it is possible to reduce the disuse portion in the metal plate corresponding to the material of the contact 3. Further, since the connection part 6 is formed in a cylindrical shape, it is easy to process even in the case of applying the bending process in the oblique direction, and a working accuracy is increased. Further, since a pitch of the contacts 3 connected to the carrier 8 can be reduced, it is possible to apply a plating to a lot of contacts 3 at a time even in the case of applying the plating to the contact portions 4 of the contacts 3.

Figure 5:
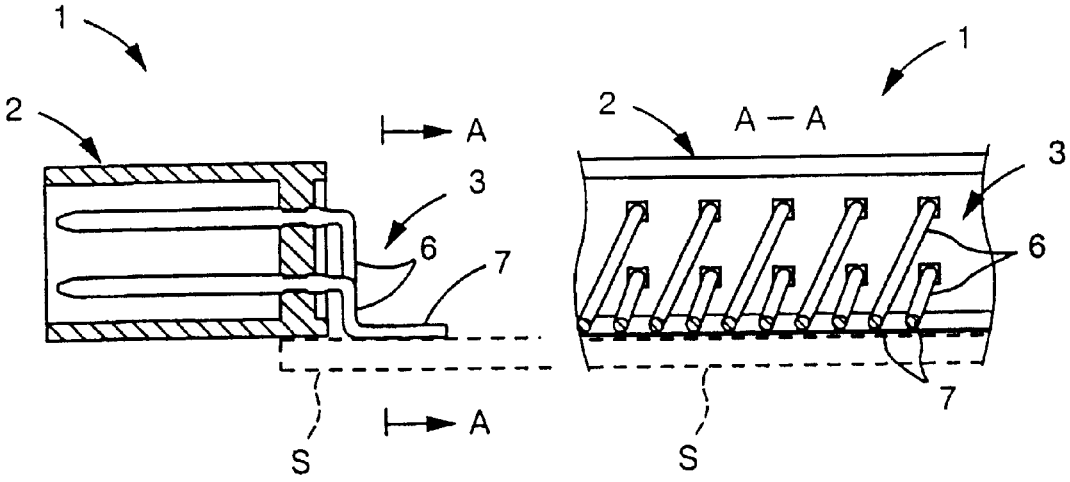
FIG. 5 is a schematic view showing a modified embodiment of the connector in accordance with the present invention.
Figure 6A:
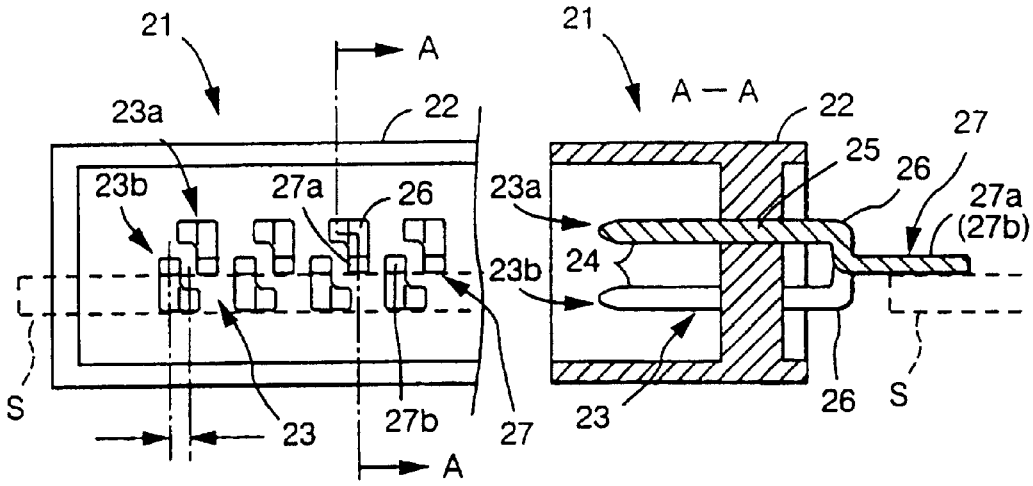
FIGS. 6(*a*) to (*c*) are schematic views showing a conventional connector.
Figure 6B:
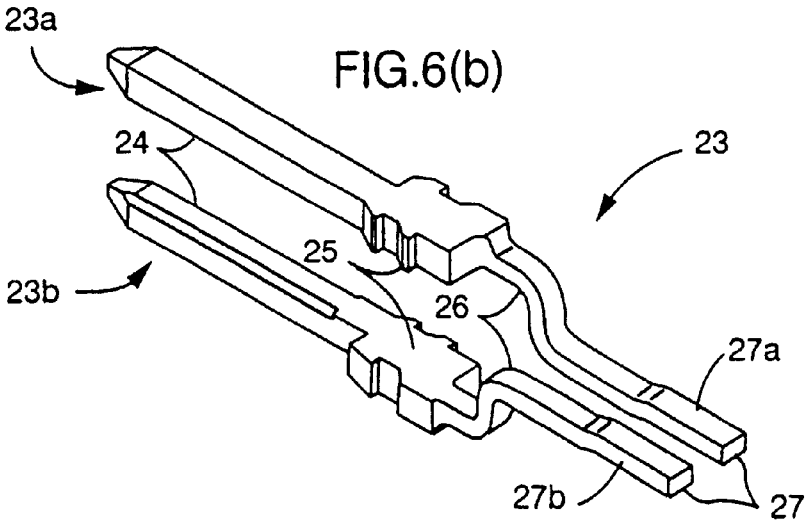
Figure 6C:
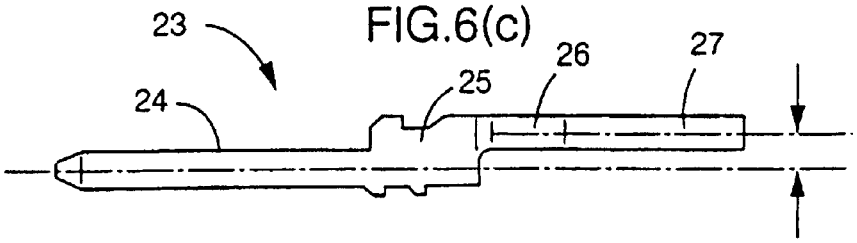

Next, a description will be given of a modified embodiment of the connector for surface mounting in accordance with the present invention. In this modified embodiment, as shown in FIG. 5, the connection parts 6 of the upper and lower contacts 3 are both bent, and the terminal parts 7 are arranged on the same surface as the lower end surface of the case 2. In the present modified embodiment, the case 2 is adhered to the circuit board S, and the terminal parts 7 arranged on the same surface as the lower end surface of the case 2 are surface-mounted on the circuit board S.

In this case, in accordance with the embodiment mentioned above, the description is given of the connector of the type that the contact 3 is pressure inserted, however, the structure is not limited to this, and the structure can be made such that the contact 3 is integrally insert-molded with the case 2.

INDUSTRIAL APPLICABILITY

As mentioned above, the present invention is useful as the connector to be surface-mounted on the circuit board employed in the personal computer or the like.

What is claimed is:

1. A connector for surface mounting comprising:

a case formed by an insulating body and comprising an opening having a non-circular cross section;

contacts formed by a conductive body and having a forward contact portion, a rearward terminal part being surface-mounted on a circuit board, and an inserted portion having a non-circular cross section, said inserted portion being inserted in said case through said opening and fitted in said opening such that said opening prevents rotation of said inserted portion;

said contacts being arranged so as to extend through said case, be held by said inserted portion and form a pair of upper and lower contacts and a plurality of parallel lines in a width direction; and terminal parts of the upper contacts and terminal parts of the lower contacts begin alternately arranged so as to form one line, characterized in that a connection part for connecting said inserted portion and said terminal part is formed with a circular cross section and obliquely bent in a width direction and a vertical direction, and the terminal parts of the upper contacts and the terminal parts of the lower contacts are alternately arranged so as to form one line.

2. A method of manufacturing a connector for surface mounting, said connector comprising a case formed by an insulating body and comprising an opening having a non-circular cross section, contacts formed by a conductive body and having a forward contact portion, a rearward terminal part being surface-mounted on a circuit board, and an inserted portion having a non-circular cross section, said inserted portion being inserted in said case through said opening and fitted in said opening such that said opening prevents rotation of said inserted portion, said contacts being arranged so as to extend through said case, be held by said inserted portion and form a pair of upper and lower contacts and a plurality of parallel lines in a width direction, and terminal parts of the upper contacts and terminal parts of the lower contacts being alternately arranged so as to form one line, characterized by the steps of:

punching a metal plate so as to form a rectangular columnar contact;

press molding said rectangular columnar contact so as to form a connection part for securing said inserted portion and said terminal part with a circular cross section;

attaching said contacts formed in the straight line shape to said case so as to form a pair of upper and lower contacts; and obliquely bending said connection part in a width direction and a vertical direction in a state of holding said terminal part horizontally so as to alternately arrange the terminal parts of the upper contacts and the terminal parts of the lower contacts in one line.

* * * * *